United States Patent [19]

Monbaliu et al.

[11] 4,061,498

[45] Dec. 6, 1977

[54] PHOTOGRAPHIC MATERIAL CONTAINING 2-ACYL-2-PYRAZOLIN-5-ON-COUPLERS

[75] Inventors: Marcel Jacob Monbaliu, Mortsel; Marc Godfried Mannens, Kessel; Raphaël Karel Van Poucke, Berchem, all of Belgium; Hans-Heinrich Credner; Ernst Meier, both of Munich, Germany

[73] Assignee: AGFA-Gevaert, N.V., Mortsel, Belgium

[21] Appl. No.: 690,583

[22] Filed: May 27, 1976

[30] Foreign Application Priority Data

May 30, 1975 Germany ..... 2524134

[51] Int. Cl.[2] ..... G03C 1/40

[52] U.S. Cl. ..... 96/100 R; 96/56.5; 548/367; 548/364; 548/365; 548/360; 260/304 R

[58] Field of Search ..... 96/100, 56.5, 66 HD, 96/9

[56] References Cited

U.S. PATENT DOCUMENTS 3,012,884 12/1961 de Ramaix et al. ..... 96/9

OTHER PUBLICATIONS

Chemical Abstracts, vol. 75, p. 317, Abstract 98566k, 1971.

*Primary Examiner*—J. Travis Brown
*Attorney, Agent, or Firm*—A. W. Breiner

[57] ABSTRACT

2-Acyl-3-pyrazolin-5-one couplers are provided for use in color photography which upon color development form 2-pyrazolin-5-one couplers capable of coupling with the oxidation products of the color developing agent.

2 Claims, No Drawings

PHOTOGRAPHIC MATERIAL CONTAINING 2-ACYL-2-PYRAZOLIN-5-ON-COUPLERS

The present invention relates to photographic materials containing 1-substituted 2-acyl-3-pyrazolin-5-one colour couplers, a process for the production of these couplers, and to the couplers themselves. The formation of coloured photographic images by the coupling of oxidized aromatic primary amino developing agents with colour couplers is well known. In this process the subtractive process of colour formation is ordinarily used and the image dyes are intended to be cyan, magenta, and yellow, being the colours complementary to the primary colours. Usually, phenol or naphthol couplers are used to form the cyan dye image, 2-pyrazolin-5-one couplers to form the magenta dye image, and couplers containing a methylene group having one or two carbonyl groups attached to it to form the yellow dye image.

It is known e.g. from the U.S. Spec. Nos. 2,575,182 and 2,865,748 to use 5-enol esters of 2-pyrazolin-5-onecolour couplers. These 5-acyloxypyrazole couplers are obtained by acylation of the corresponding 2-pyrazolin-5-one couplers with an acid chloride or anhydride. Although the 5-acyloxypyrazole compounds no longer contain a reactive methylene group in the 4-position, they can couple with the oxidized developing agent and form a dye by reformation of the free 2-pyrazolin-5-one coupler through splitting off of the acid ester radical prior to or simultaneously with the colour development. These couplers have the advantage that they cannot take part in any undesirable side-reaction before the colour development because of the presence of an inactive methylene group.

The 5-enol esters of 2-pyrazolin-5-one couplers having an alkyl, aryl, or acylamino group in the 3-position can easily be prepared whereas the 2-pyrazolin-5-one couplers having an anilino group in the 3-position, which as magenta colour couplers are particularly advantageous, can hardly be converted into the 5-enol esters by acylation with carboxylic acid chlorides.

It is an object of the invention to prepare 2-acyl-3-pyrazolin-5-one compounds substituted in the 1- and 3-position, which comprise an inactive methylene group and which in alkaline medium are converted into 2-pyrazolin-5-one compounds substituted in the 1- and 3-position.

Another object of the invention is to use 2-acyl-3-pyrazolin-5-one compounds substituted in the 1- and 3-position as couplers in colour photographic materials, the conversion into 2-pyrazolin-5-one compound in alkaline medium occurring prior to or during the colour development.

It has been found now that 2-acyl-3-pyrazolin-5-one compounds substituted in the 1- and 3-position can be prepared, the acyl group deriving from organic carboxylic acids or from carboxylic acid esters.

The compounds according to the invention are prepared by conversion of 2-pyrazolin-5-one compounds carrying substituents in the 1- and 3-position, with carboxylic acid halides, i.e. carboxylic acid chloride or chloroformiates.

The invention also relates to a photographic material having at least one silver halide emulsion layer, said material containing in at least one layer a 2-acyl-3-pyrazolin-5-one substituted in the 1- and 3-position as coupler capable of oxidative coupling with a p-phenylene diamine colour developing agent.

Particularly preferred compounds correspond to the following general formula:

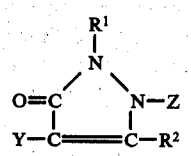

wherein:

$R^1$ represents a substituent of the type customarily used in 2-pyrazolin-5-one colour couplers, preferably (1) a $C_1$–$C_{22}$ alkyl group, especially $C_1$–$C_5$ alkyl, which may be substituted, e.g. with halogen e.g. 2,2,2,-trifluoroethyl, with cyano, e.g. cyanoethyl or with phenyl, which phenyl group in its turn may be substituted in the same way as the aryl group defined hereinafter, e.g. benzyl and chlorobenzyl, or (2) an aryl group e.g. phenyl, which may carry one or more substituents such as alkyl e.g. methyl, halogen (e.g. chlorine and bromine), sulpho, alkoxy (e.g. methoxy), phenoxy, alkylsulphonyl (e.g. methylsulphonyl), alkylthio (e.g. methylthio), carbalkoxy, haloalkoxy, haloalkylthio, haloalkylsulphonyl, sulphamoyl, carbamoyl, cyano, nitro, etc.

$R^2$ 1. alkyl, especially $C_1$–$C_{22}$ alkyl including substituted alkyl,
2. aryl including substituted aryl,
3. anilino including anilino substituted with one or more of the common groups e.g. alkyl, alkoxy, alkylthio, aryloxy, halogen such as chloro, nitro, cyano, sulpho, amino, substituted amino, e.g. carboxyl- or sulphonacylamino, sulphamyl, carbamyl and the like, or
4. acylamino including substituted acylamino e.g. acetylamino, propionylamino, acrylamino, methacrylamino, palmitoylamino, and benzoylamino, which may have one or more common substituents on the phenyl nucleus e.g. halogen, such as chloro and bromo, alkyl such as methyl, alkoxy such as methoxy, ethoxy, n-hexadecyloxy, aroxy such as phenoxy and substituted phenoxy, acylamino such as acetylamino, phenoxyacetylamino, α-(2,4-di-t-amylphenoxy)-acetylamino and the like, Y represents 1. hydrogen;
2. a group that can be split off during colour development such as halogen e.g. chloro, a sulpho group in acid or salt form, alkoxy, e.g. methoxy, aryloxy e.g. phenoxy, acyloxy, an alkylthio group, an arylthio group e.g. phenylthio, a heterocyclic thio group e.g. 1-phenyl-5-tetrazolylthio, 2-benzothiazolylthio, and 2-benzimidazolythio, an arylazo group e.g. phenylazo, chlorophenylazo, and methoxyphenylazo, or a benzotriazolyl-group, or
3. alkyl, e.g. methyl as in the known 2-pyrazolin-5-one competing couplers forming colourless products upon photographic colour development, and

Z 1. an acyl group deriving from an organic carboxylic acid e.g. an acyl group deriving from saturated or unsaturated aliphatic, cycloaliphatic, aliphaticaromatic, aromatic, or heterocyclic carboxylic acids, such as e.g. acetyl, propionyl, palmitoyl, alkoxyacetyl (e.g. methoxyacetyl and ethoxyacetyl), aryloxyacetyl (e.g. phenoxyacetyl), β-carboxypropionyl, chloroacetyl, benzoyl, chlorobenzoyl, thienoyl, or the group

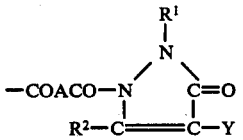

in which:

$R^1$, $R^2$, and Y have the significance given hereinbefore, and A being an alkylene group e.g. ethylene, or arylene e.g. phenylene, or 2. an alkoxycarbonyl or aryloxycarbonyl group which may be substituted e.g. methoxycarbonyl, ethoxycarbonyl, trichloroethoxycarbonyl, benzyloxycarbonyl, phenoxycarbonyl, sulphophenoxycarbonyl, alkoxycarbonylphenoxycarbonyl, and the like.

The compounds according to the invention can be prepared by reaction of the corresponding 2-pyrazolin-5-one as starting product with an organic carboxylic acid halide in particular a carboxylic acid chloride or a chloroformiate.

The reaction is carried out preferably in an anhydrous inert organic solvent e.g. nitrobenzene, nitromethane, tetrahydrothiophene-1,1-dioxide, acetonitrile, dioxan or especially in halogenated aliphatic hydrocarbons such as dichloromethane, 1,2-dichloroethane or carbon tetrachloride.

If in the preparation of the compounds according to the invention chloroformiate is used as acylating agent, the inert solvent may be replaced wholly or partially by excess chloroformiate.

The reaction of the 2-pyrazolin-5-one is performed in the presence of a Friedel-Crafts catalyst especially a metal halide such as aluminium halide e.g. aluminium chloride and a basic heterocyclic nitrogen-containing condensating agent such as pyridine or a derivative thereof e.g. lutidine or picoline at temperature below 20° C, especially between −20° C and +10° C.

If, however, 3-anilino-2-pyrazolin-5-one is used as starting product and chloroformiate as acylating agent, it is sufficient to reflux the reagents in the inert solvent.

In the case of an unsubstituted amino group in the 3-position of 2-pyrazolin-5-one the reaction is preferably carried out between −20° C and 0° C, since in this temperature range there is only acylated in 2-position, whereas at higher temperatures the 3-acylaminopyrazolone compound is formed (see the U.S. Pat. Nos. 3,325,482 and 3,846,444). In order to prepare the 2-acyl-3-acylamino-3-pyrazolin-5-one compounds according to the invention the 2-acyl-3-amino-3-pyrazolin-5-one is prepared first by acylation in the presence of a Friedel-Crafts metal halide and a basic condensation agent at relatively low temperatures preferably below 0° C. The resulting product is then acylated in the 3-position according to known methods e.g. in the presence of a Friedel-Crafts metal halide, in an anhydrous inert solvent such as those defined hereinbefore.

If Friedel-Crafts metal halides are used for the preparation of the compounds according to the invention the halide is taken in almost equimolar amounts in respect of the amount of the 2-pyrazolin-5-one. However, to simplify the solution of the pyrazolin-5-one the metal halide may be used in excess with a molar proportion of approximately 1:1.5.

It is obvious that preferred substituents can be introduced into the groups $R^1$, $R^2$, and Y subsequent to the 2-acylation according to known chemical methods.

The following examples illustrate the preparation of the compounds according to the invention.

The four conceivable isomeric structures (acylation in the 2-, 3-, 4-, or 5-position) differ by their IR- and NMR-spectra. The 2- and 5-acylated compounds contain no enolizable active proton in the 4-position and differ from each other by the IR-absorption frequency (in dichloromethane) of the introduced carbonyl group, i.e. beyond 5.60 μm in the case of the 2-acylated compounds and below 5.60 μm in the case of the 5-acylated compounds.

COMPOUND 1

1-phenyl-2-phenoxycarbonyl-3-amino-3-pyrazolin-5-one 8 ml (0.01 mole) of pyridine and 27.4 ml (0.22 mole) of phenyl chloroformiate are added consecutively to a suspension cooled to −10° C of 35 g (0.2 mole) of 1-phenyl-3-amino-2-pyrazolin-5-one and 40 g (0.3 mole) of anhydrous aluminium chloride in 150 ml of dichloromethane, the temperature being kept below −5° C.

At a temperature below 0° C 16 ml (0.2 mole) of pyridine in 4 batches of 4 ml each are added (one batch every 15 min) in a total period of 1 h.

The reaction mixture is stirred for 2 h, agitated with 1N aqueous hydrochloric acid, and washed with water until free from acid. The dichloromethane layer is dried, whereupon 500 ml of hexane are added. The resulting precipitate is filtered off.

Yield: 48 g (81%). Melting point: 200° C.

Structural analysis

IR $\nu_{CO}$ 5.72 nm NMR $\delta_{.CH=}$ 4.75

COMPOUND 2

1-phenyl-2-ethoxycarbonyl-3-amino-3-pyrazolin-5-one 133.5 g (1 mole) of anhydrous aluminium chloride and 175 g (1 mole) of 1-phenyl-3-amino-2-pyrazolin-5-one are dissolved in 1000 ml of acetonitrile at 40°–50° C. 240 ml (3 moles) of pyridine are added dropwise to the solution at 60°–65° C. The clarified solution was cooled to −5° C. 119.3 g (1.1 mole) of ethyl chloroformiate are added and the resulting solution is stirred for 2 h at 0° C. The mixture is poured out in water. The precipitate is recrystallized from acetonitrile.

Yield: 99 g (40%). Melting point: 146° C.

Structural analysis

IR ($CH_2Cl_2$) $\nu_{CO}$ 5.73 NMR ($CDCl_3$) $\delta_{.CH=}$ 4.60

COMPOUND 3

1-(4-hexadecylsulphonylphenyl)-2-ethoxycarbonyl-3amino-3-pyrazolin-5-one 40 g (0.3 mole) of anhydrous aluminium chloride are added to a suspension of 92.6 g of (0.2 mole) of 1-(4-hexadecylsulphonylphenyl)-3-amino-2-pyrazolin-5-one in 500 ml dichloromethane. The temperature rises to 35° C thereby and a solution is obtained. The resulting solution is cooled to −5° C and 8 ml (0.1 mole) of pyridine are added. 21 ml (0.22 mole) of ethyl chloroformiate are added at −5° C, whereupon 16 ml (0.2 mole) divided into 4 portions of 4 ml each are added (one portion every 15 min) in a total period of time of 1 h, the temperature being kept below 0° C. The mixture is stirred for 4 h and poured then into 1N aqueous hydrochloric acid. The precipitate is filtered off and rinsed. The wet product is stirred with 500 ml of isopropylether and the precipitate is sucked off (melting point: 92° C). The product is recrystallized from acetonitrile.

Yield: 75 g (70%). Melting point : 97° C.

Structural analysis

IR ($CH_2Cl_2$) $\nu_{CO}$ 5.73 NMR ($CDCl_3$) $\delta_{-CH=}$ 4.70

COMPOUND 4

1-(4-hexadecylsulphonylphenyl)-2-phenoxycarbonyl-3-amino-3-pyrazolin-5-one

Analogously to compound 3 91.5 g (78.5%) of the above compound having a melting point of 155° C are obtained from 92.6 g (0.2 mole) of 1-(4-hexadecylsulphonylphenyl)-3-amino-2-pyrazolin-5-one, 40 g of anhydrous aluminum chloride, 24 ml (0.3 mole) of pyridine and 27.4 ml (0.22 mole) of phenyl chloroformiate.

Structural analysis

NMR ($CDCl_3$) $\delta_{-CH=}$ 4.80

COMPOUND 5

1-(2,4,6-trichlorophenyl)-2-phenoxycarbonyl-3-amino-4-chloro-3-pyrazolin-5-one 15.6 ml (0.05 mole) of 1-(2,4,6-trichlorophenyl)-3amino-4-chloro-2-pyrazolin-5-one, 10 g (0.075 mole) of anhydrous aluminum chloride and 2 ml of pyridine are added consecutively to 50 ml of dichloromethane. 8.6 g of phenyl chloroformiate are added to the resulting solution cooled to −10° C. Subsequently 4 ml (0.05 mole) of pyridine divided into 4 portions of 1 ml each are added (one portion every 15 min) in a total period of time of 1 h. The resulting mixture is stirred for 1 h, whereupon it is diluted with 200 ml of dichloromethane, and agitated with 25 ml of concentrated aqueous hydrochloric acid. The dichloromethane layer is washed with water until free from acid, dried, and concentrated by evaporation. The product obtained is recrystallized from acetonitrile.

Yield : 14 g (65%). Melting point : 196° C.

Structural analysis

IR ($CH_2Cl_2$) $\nu_{CO}$ 5.70

COMPOUND 6

1-phenyl-2-phenoxycarbonyl-3-methyl-3-pyrazolin-5-one 35 g (0.2 mole) of 1-phenyl-3-methyl-2-pyrazolin-5-one and 35.4 g (0.25 mole) of anhydrous aluminum chloride are added consecutively with stirring to 100 ml of dichloromethane. 1 ml of pyridine and 28 ml (0.22 mole) of phenyl chloroformiate are added to the solution cooled down to −10° C. 16 ml (0.2 mole) of pyridine, divided into portions of 4 ml each (one portion every 15 min) are added in a total period of time of 1 h at a temperature between −5° C and 0° C. The reaction mixture is stirred for 3 h at 0° C and then poured out into a mixture of 1 l of water and 50 ml of concentrated aqueous hydrochloric acid. After the addition of 100 ml of dichloromethane the dichloromethane layer is separated, washed with water until free from acid, dried, and poured out in hexane. The precipitate is dried. Yield: 40 g (66%). Melting point : 153° C.

Structural analysis

IR ($CH_2Cl_2$) $\nu_{CO}$ 5.67 NMR ($CDCl_3$) $\delta_{-CH=}$ 5.60

COMPOUND 7

1-(2,4,6-trichlorophenyl)-2-acetyl-3-(2-chloro-5-myristoylaminoanilino)-3-pyrazolin-5-one 1.07 g (0.01 mole) of lutidine is added to a solution of 30.7 g (0.05 mole) of 1-(2,4,6-trichlorophenyl)-3-(2-chloro-5-myristoylaminoanilino)-2-pyrazolin-5-one and 8 g (0.06 mole) of anhydrous aluminium chloride in 100 ml of dichloromethane. The solution is cooled to 10° C and 5.90 g (0.075 mole) of acetylchloride are added. 8 g (0.075 mole) of lutidine divided into 4 portions of 2 g each (one portion every 15 min) are added in a total period of time of 1 h, the temperature being kept below 10° C. The reaction mixture is stirred for 2 h more and then poured out into 1 l of 1N aqueous hydrochloric acid. The dichloromethane layer is washed until free from acid, dried, and concentrated by evaporation. The product is agitated with methanol.

Yield: 19 g (58%). Melting point : 139° C.

Structural analysis

IR ($CH_2Cl_2$) $\nu_{CO}$ 5.92 $\nu$m NMR ($CDCl_3$) $\delta_{-CH=}$ 5.58

The higher IR-absorption frequency of the carbonyl group of this compound as compared with that of the carbonyl group of compounds 1 to 6 is explained by the introduction of a CO group (instead of a –COO group), which overlaps the absorption frequency of the carbonyl group of the pyrazole nucleus.

COMPOUNDS 8 to 16

In an analogous way the 3- pyrazolin-5-ones of the following table are prepared:

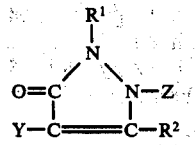

| | $R^1$ | $R^2$ | Y | Z | Melting point ° C | Structural analysis IR ($CH_2Cl_2$) | NMR ($CDCl_3$) |
|---|---|---|---|---|---|---|---|
| 8 | phenyl | amino | methyl | phenoxy- | 164 | 5.73 μm | — |

-continued

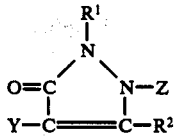

| | $R^1$ | $R^2$ | Y | Z | Melting point °C | Structural analysis IR ($CH_2Cl_2$) | NMR ($CDCl_3$) |
|---|---|---|---|---|---|---|---|
| 9 | phenyl | methyl | H | carbonyl acetyl | 86 | 5.90 μm | 5.48 |
| 10 | 2,4,6,-tri-chlorophenyl | amino | H | phenoxy-carbonyl | 194 | 5.71 μm | 4.90 |
| 11 | 2,4,6-tri-chlorophenyl | amino | H | ethoxy-carbonyl | 194 | — | — |
| 12 | phenyl | amino | H | acetyl | 190 | 5.90 μm | 4.60 |
| 13 | phenyl | p-chloro-anilino | H | acetyl | 169 | 5.81 μm | 5.00 |
| 14 | phenyl | p-chloro-anilino | H | benzoyl | 179 | 5.84 μm | 5.18 |
| 15 | m-chloro-phenyl | amino | H | ethoxy-carbonyl | 120 | 5.70 μm | 4.58 |
| 16 | benzyl | amino | H | ethoxy-carbonyl | 106 | 5.76 μm | 4.70 |

COMPOUND 17

1-(2,4,6-trichlorophenyl)-2-phenoxycarbonyl-3-(2-chloro-5-myristoylamino-anilino)-3-pyrazolin-5-one A solution of 30.7 g (0.05 mole) of 1-(2,4,6-trichlorophenyl)-3-(2-chloro-5-myristoylamino-anilino)-2-pyrazolin-5-one and 15.6 g (0.1 mole) of phenyl chloroformiate in 100 ml of acetonitrile are refluxed for 4 h. The solution is poured out in water and the separated oil is stirred first with water and next with methanol. The precipitate is recrystallized from ethanol.

Yield: 20 g (54%). Melting point : 124° C.

Structural analysis

IR $\nu_{CO}$ 5.73 δm NMR $\delta_{-CH=}$ 5.82 ppm

COMPOUND 18

1-(2,4,6-trichlorophenyl)-2-(4-methoxycarbonyl-phenoxycarbonyl)-3-(2-chloro-5-myristoylamino-anilino)-3-pyrazolin-5-one A solution of 24.5 g (0.04 mole) of 1-(2,4,6-trichlorophenyl)-3-(2-chloro-5-myristoylamino-anilino)-2-pyrazolin-5-one and 17.16 g (0.8 mole) of methoxycarbonylphenyl chloroformiate (Chem.Ztg. 390 (1886)) in 100 ml of dry dichloromethane is refluxed for 8 h. The solution is concentrated by evaporation and the white precipitate is recrystallized from methanol. Yield : 27 g (69%). Melting point : 156° C.

Structural analysis

IR $\nu_{CO}$ 5.72 μm NMR $\delta_{-CH=}$ 5.85 ppm

COMPOUND 19

1-(2,4,6-trichlorophenyl)-2-ethoxycarbonyl-3-(2-chloro-5-myristoylamino-anilino)-3-pyrazolin-5-one a. Analogously to compound 18:16 g (51%) of the above mentioned compound melting at 136° C are obtained from 30.7 g (0.05 mole) of the 2-pyrazolin-5-one and 10.85 g (0.1 mole) of ethyl chloroformiate.

Structural analysis

IR $\nu_{CO}$ 5.76 μm NMR $\delta_{-CH=}$ 5.65 ppm b. 12 ml (0.15 mole) of pyridine are added dropwise at 10° C to a solution of 30.7 g (0.05 mole) fo the corresponding 2-pyrazolin-5-one, 8 g (0.06 mole) of anhydrous aluminium chloride, and 150 ml of acetonitrile. 5.25 ml (0.055 mole) of ethyl chloroformiate are added dropwise in 5 min at 5°–10° C to the resulting suspension. 200 ml of dimethylformamide are then added to the solution of the reaction mixture. The mixture is stirred for 1 h and then poured out into a mixture of 100 ml of methanol and 100 ml of 1N aqueous hydrochloric acid. The precipitate is sucked off and recrystallized from methanol.

Yield: 26 g (76%). Melting point : 137° C.

COMPOUND 20

1-(2,4,6-trichlorophenyl)-2-benzyloxycarbonyl-3-(2-chloro-5-hexadecyloxycarbonyl-anilino)-3-pyrazolin-5-one 6.7 g (0.01 mole) of 1-(2,4,6-trichlorophenyl)-3-(2-chloro-5-hexadecyloxycarbonyl-anilino)-2-pyrazolin-5-one are refluxed for 3 h with 70 ml of a 50% solution of benzyl chloroformiate in toluene. Subsequently, all volatile components are distilled off carefully under reduced pressure and the residue is recrystallized from methanol. Yield: 4.6 g (57%). Melting point: 128°–131° C.

COMPOUND 21

1-(2,4,6-trichlorophenyl)-2-phenoxycarbonyl-3-{2-chloro-5-[β-(2-cyclopentyl-4-t-butylphenoxy)-ethoxycarbonylamino]-anilino}-3-pyrazolin-5-one In accordance with the preparation of compound 18, 18 g (44%) of the above compound melting at 154° C are obtained from 34.6 g (0.05 mole) of the corresponding 2-pyrazolin-5-one and 15.6 g (0.1 mole) of phenyl chloroformiate after recrystallization from acetonitrile.

Structural analysis

IR $\nu_{CO}$ 5.74 μm NMR $\delta_{-CH=}$ 5.80 ppm

COMPOUND 22

1-(2-methyl-4,6-dichlorophenyl)-2-ethoxycarbonyl-3-[4-(N-phenyl-N-n-hexadecylsulphamoyl)-anilino]-3-pyrazolin-5-one A solution of 28.5 g (0.04 mole) of the corresponding 2-pyrazolin-5-one and 10.85 g (0.1 mole) of ethyl chloroformiate in 80 ml of acetonitrile is refluxed for 6 h. The solution is poured into water and the oil formed is separated and dissolved in diethyl ether. Hexane is added to the dried solution and the white precipitate formed is collected.

Yield: 15 g (39%). Melting point: 85° C.

Structural analysis

IR $\nu_{CO}$ 5.77 μm NMR $\delta_{-CH=}$ 5.48 ppm

COMPOUND 23

1-(2,4,6-trichlorophenyl)-2-(4-methoxycarbonylphenoxycarbonyl)-3-[β-(m-pentadecylphenoxy)-ethoxycarbonylaminoanilino]-3-pyrazolin-5-one A solution of 37.2 g (0.05 mole) of the corresponding 2-pyrazolin-5-one and 17 g (0.075 mole) of 4-methoxycarbonylphenyl chloroformiate in 100 ml of dry dichloromethane is refluxed for 5 h. The reaction mixture is poured into hexane. The oil formed is separated and boiled twice in isopropyl ether. The precipitate is separated and recrystallized from isopropyl ether/methanol.

Yield: 15 g. Melting point: 101°-104° C.

Structural analysis

IR $\nu_{CO}$ 5.755 μm NMR $\delta_{-CH=}$ 5.18 ppm

COMPOUND 24

1-phenyl-2-ethoxycarbonyl-3-p-chloroanilino-3-pyrazolin-5-one

A solution of 14.3 g (0.05 mole) of 1-phenyl-3-p-chloroanilino)-2-pyrazolin-5-one and 10.85 g (0.1 mole) of ethyl chloroformiate in 100 ml of dioxan was refluxed for 4 h. The solution was poured into water and the precipitate formed was recrystallized from methanol.

Yield: 12.5 g (70%). Melting point: 154° C.

Structural analysis

IR $\nu_{CO}$ 5.72–5.77 μm NMR $\delta_{-CH=}$ 5.12 ppm

COMPOUND 25

1-(2,4,6-trichlorophenyl)-2-ethoxycarbonyl-4-chloro-3-(2-chloro-5-myristoylamino-anilino)-3-pyrazolin-5-one 4.45 ml (0.055 mole) of sulfuryl chloride are added dropwise in 15 min at −50° C to a cooled solution of 34.4 g (0.05 mole) of 1-(2,4,6-trichlorophenyl)-2-ethoxycarbonyl-3-(2-chloro-5-myristoylamino-anilino)-3-pyrazolin-5-one (compound 19) in 100 ml dichloromethane.

The resulting mixture is stirred for 1 h at −50° C. The dichloromethane layer is washed until free from acid and dried. The solvent is then removed by evaporation and the product is recrystallized from ethanol. Melting point: 145° C.

COMPOUND 26

1-(2,2,2-trifluoroethyl)-2-phenyoxycarbonyl-3-(p-N-methyl-N-hexadecylsulfamylanilino)-3-pyrazolin-5-one A solution of 5.7 g (0.01 mole) of 1-(2,2,2-trifluoroethyl)-3-(p-N-methyl-N-hexadecylsulfamylanilino)-2-pyrazolin-5-one and 3.1 g (0.02 mole) of phenyl chloroformiate in 25 ml of dichloromethane are refluxed for 48 h. After concentration by evaporation the mixture is stirred in isopropyl ether and the precipitate is collected and dried. Melting point: 60° C.

Structural analysis

IR $\nu_{CO}$ 5.707 μm NMR $\delta_{-CH=}$ 5.38 ppm

COMPOUND 27

1-phenyl-2-ethoxycarbonyl-3-palmitoylamino-3-pyrazolin-5-one 24.7 g (0.1 mole) of 1-phenyl-2-ethoxycarbonyl-3-amino-3-pyrazolin-5-one (compound 2) and 30.2 g (0.11 mole) of palmitoylchloride are dissolved consecutively in a solution of 13.3 g (0.1 mole) of anhydrous aluminium chloride in 100 ml of nitrobenzene. The mixture is stirred for 1 h at room temperature and poured out in 500 ml of water. The precipitate is stirred with methanol, filtered off, and recrystallized from ethanol.

Yield: 24 g (50%). Melting point: 107° C.

COMPOUND 28

1-phenyl-2-ethoxycarbonyl-3-benzoylamino-3-pyrazolin-5-one 15.4 g (0.11 mole) of benzoyl chloride are added at room temperature to a solution of 24.7 g (0.1 mole) of 1-phenyl-2-ethoxycarbonyl-3-amino-3-pyrazolin-5-one (compound 2),3 ml of nitrobenzene, and 26.7 g (0.2 mole) of anhydrous aluminium chloride in 100 ml of acetonitrile. The solution is refluxed for 3 h and then poured out into water. The precipitate is filtered off, rinsed with water, dried, and recrystallized from acetonitrile.

Yield: 19.4 g (55%). Melting point: 172° C.

COMPOUND 29

1-phenyl-2-phenoxycarbonyl-3-benzoylamino-3-pyrazolin-5-one

Analogously to compound 28 12 g (60%) of the above compound melting at 232° C were obtained from 14.75 g (0.05 mole) of 1-phenyl-2-phenoxycarbonyl-3-amino-3-pyrazolin-5-one (compound 1), 13.55 g (0.1 mole) of anhydrous aluminium chloride, and 6.4 ml (0.055 mole) of benzoyl chloride in 50 ml of dichloromethane.

COMPOUND 30

1-phenyl-2-phenoxycarbonyl-3-p-hexadecyloxybenzoylamino-3-pyrazolin-5-one 19 g (0.05 mole) of p-hexadecyloxybenzoyl chloride were added at room temperature to a suspension of 12 g (0.04 mole) of 1-phenyl-2-phenoxycarbonyl-3-amino-3-pyrazolin-5-one (compound 1) and 13.35 g (0.1 mole) of anhydrous aluminium chloride in 200 ml of dichloromethane. The resulting mixture is stirred for 2 h first at room temperature and subsequently for 10 min at boiling temperature. The dichloromethane layer was separated, washed with 5N aqueous hydrochloric acid, and rinsed with water until free from acid. After drying and filtration through acetylcellulose the dichloromethane solution was concentrated by evaporation and the residue was recrystallized from ethyl acetate.

Yield: 10 g (39%). Melting point: 100° C.

COMPOUND 31

1-phenyl-2-ethoxycarbonyl-3-methacryloylamino-3-pyrazolin-5-one 123.5 g (0.5 mole) of 1-phenyl-2-ethoxycarbonyl-3-amino-3-pyrazolin-5-one (compound 2) are dissolved at room temperature in a solution of 133.5 g (1 mole) of anhydrous aluminium chloride and 15 ml of nitrobenzene in 500 ml of acetonitrile. The resulting solution is mixed with 57.5 g (0.55 mole) of methacryloyl chloride and is then refluxed for 3 h. The reaction mixture is poured out in 1 l of water and the precipitate formed is separated. The product is recrystallized from benzene/-hexane (1:1).

Yield: 96 g (61%). Melting point: 113° C.

COMPOUND 32–33

32.

1-(2,4,6-trichlorophenyl)-2-(p-fluorosulphonylphenoxycarbonyl)-3-(2-chloro-5-myristoylamino-anilino)-3-pyrazolin-5-one

33.

1-(2,4,6-trichlorophenyl)-2-(β,β,β-trichloroethoxycarbonyl)-3-(2-chloro-5-myristoylamino-anilino)-3:pyrazolin-5-one These compounds were prepared as described for compound 17.

COMPOUND 34

1-(2,6-dichloro-4-methylsulphonylphenyl)-2-phenoxycarbonyl-3-[2-chloro-5-(N-methyl-N-hexadecylsulphamoyl)-anilino]-3-pyrazolin-5-one This compound was prepared as described for compound 22.

Yield: 77%. Melting point: 60° C.

COMPOUND 35

1-(2,6-dichloro-4-methylsulphonylphenyl)-2:acetyl-3-[2-chloro-5-(N-methyl-N-hexadecylsulphamoyl)-anilino]-3-pyrazolin-5-one This compound was prepared as described for compound 7.

Yield: 55%. Melting point: 130° C.

COMPOUND 36

1-(2,6-dichloro-4-methylsulphonylphenyl)-2-acetyl-3-[2-chloro-5-(N-methyl-N-hexadecylcarbamoyl)-anilino]-3-pyrazolin-5-one This compound was prepared as described for compound 7.

Yield: 53%. Melting point: 70° C.

The 1-substituted 2-acyl-3-pyrazolin-5-one compounds according to the present invention can be used as coloured or uncoloured couplers and as competing couplers in photographic elements comprising at least one silver halide emulsion layer.

Since no active methylene group is present as in the case of conventional couplers these couplers cannot participate in undesireable side-reactions with other emulsion ingredients e.g. traces of aldehyde hardening agents such as formaldehyde and mucochloric acid during manufacture and storage, which would result in a reduction of the amount of coupler available for coupling with the oxidized developer and consequently in a reduction of the dye density and in the production of stains, etc. However, the coupling reaction in alkaline medium is possible, since the acyl group is split off, thus leading to the formation of free 2-pyrazolin-5-one coupler available for coupling.

During the manufacture of suitable photographic multilayer materials containing colour couplers for the formation of separation images in the differently sensitized silver halide emulsion layers or competing couplers, the couplers have to be incorporated in non-diffusing form into the hydrophilic silver halide emulsion layers or into water-permeable adjacent layers.

In order to reduce the tendency towards diffusion of the couplers according to the invention in the photographic colloid layers they may carry a ballasting group e.g. in the 1- or 3-position of the pyrazolin-5-one nucleus. Groups $R^1$ and $R^2$ may e.g. be an acyclic aliphatic hydrocarbon group having 5 to 20 carbon atoms or they may contain such a group, linked through one of the following atoms or groups: sulphur, sulphonyl, —NH-CO—, —$NHSO_2$, —N(alkyl)—, —CON($R^3$)—or —$SO_2N(R^3)$—, $R^3$ being hydrogen or alkyl.

Another method of making the couplers of the invention fast to diffusion in hydrophilic colloid layers is to use the couplers in polymeric form e.g. by copolymerisation of monomeric couplers according to the invention comprising in the 3-position an ethylenic group of the formula:

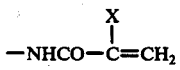

wherein X is hydrogen, halogen, $C_1$–$C_5$ alkyl, aralkyl or aryl, with one or more non-dye-forming monomers comprising at least one ethylenic group.

The present invention is concerned therefore also with monomeric 3-pyrazolin-5-one couplers according to the above general formula in which $R^2$ represents an acylamino group corresponding to the following formula:

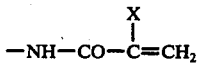

in which X has the significance defined above, as well as with polymeric couplers containing recurring units according to the following general formula:

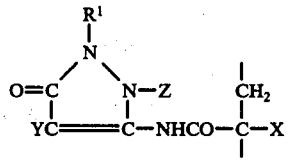

in which $R^1$, Z, Y, and X have the significance defined above.

The following preparatory example illustrates the making of such polymeric couplers.

COMPOUND 37

Copolymer of butyl acrylate, methacrylic acid, and 1-phenyl-2-ethoxycarbonyl-3-methacryloylamino-3-pyrazolin-5-one.

5 g of the sodium salt of oleylmethyltauride are dissolved in 300 ml of demineralized water and 40 g of 1-phenyl-2-ethoxycarbonyl-3-methacryloylamino-3-pyrazolin-5-one (compound 31) are suspended therein.

The resulting mixture is heated to 90° C. 12.5 ml of a 1% aqueous solution of the sodium salt of 4,4-azo-bis(4-cyano-valeric acid) are added. A mixture of 40 g of methacrylic acid and 20 g of butyl acrylate as well as 37.5 ml of a 1% aqueous solution of the sodium salt of 4,4-azo-bis(4-cyanovaleric acid) are added dropwise after 10 min within 30 min. The mixture is refluxed for 1 hour and cooled afterwards. The resulting latex is centrifuged for 30 min at 4200 revolutions/min. Yield: 425 ml of latex. The concentration of solids per 100 ml of latex: 15.7 g. Equivalent molar weight (i.e. the number of g of polymer, in which 1 mole of polymerized monomeric coupler is contained): 1601.

The non-diffusing couplers according to the invention containing a ballasting group in the 1- or 3-position can be incorporated into the photographic silver halide material according to any suitable known process. The couplers are incorporated preferably into photographic hydrophilic colloid media from solutions in high-boiling sparingly water-miscible solvents such as di-n-butyl phthalate and tricresyl phosphate, or in low-boiling sparingly water-miscible solvents such as ethyl acetate, methylene chloride, diethyl carbonate, chloroform and the like, or mixtures thereof.

For this purpose these solutions can be dispersed in extremely fine droplets, preferably in the presence of one or more wetting or dispersing agents, into the hydrophilic colloid medium e.g. aqueous gelatin, or into water, the low-boiling sparingly water-miscible solvent being removed then by evaporation. The stable dispersions of the colour couplers can be stored as such and then admixed whenever desired with the very coating composition of the hydrophilic colloid layer such as a silver halide emulsion layer, into which the compounds have to be present.

Of course, the compounds according to the invention can be incorporated in another way into the hydrophilic colloid media.

More details about particularly suitable techniques that may be employed for incorporating the colour couplers of the invention into a hydrophilic colloid layer of a photographic material can be found in the U.S. Pat. Nos. 2,269,158 — 2,284,887 — 2,304,939 — 2,304,940 and 2,322,027, United Kingdom patent specifications Nos. 791,219 — 1,098,594 — 1,099,414 — 1,099,415 — 1,099,416 — 1,099,417 — 1,218,190 — 1,272,561 — 1,297,347 and 1,297,947, French patent specification 1,555,663, Belgian Patent Specification 722,026, and German Patent Specification 1,127,714.

The couplers according to the invention can be used in conjunction with various kinds of photographic emulsions. Various silver salts can be used as the sensitive salt e.g. silver bromide, silver iodide, silver chloride or mixed silver halides such as silver chlorobromide, silver bromoiodide, and silver chlorobromoiodide. The couplers can be used in emulsions of the mixed packet type as described in U.S. Pat. No. 2,698,794 or emulsions of the mixed grain type as described in U.S. Pat. No. 2,592,243. The colour couplers can be used with emulsions in which latent images are formed predominantly at the surface of the silver halide crystal, or with emulsions in which latent images are formed predominantly inside the silver halide crystal.

The hydrophilic colloid used as the vehicle for the silver halide may be, e.g. gelatin, colloidal albumin, zein, casein, a cellulose derivative, a synthetic hydrophilic colloid such as polyvinyl alcohol, poly-N-vinylpyrrolidone, etc. If desired, compatible mixtures of two or more of these colloids can be employed for dispersing the silver halide.

The light-sensitive silver halide emulsions for use in the preparation of a photographic material according to the present invention can be sensitized chemically as well as optically. They can be sensitized chemically by effecting the ripening in the presence of small amounts of sulphur-containing compounds such as allyl thiocyanate, allyl thiourea, sodium thiosulphate, etc. The emulsions can also be sensitized by means of reductors, e.g. tin compounds as described in the French Patent Specification 1,146,955 and in the Belgian Patent Specification 568,687, imino-aminomethane sulphinic acid compounds as described in the United Kingdom patent specification No. 789,832 and small amounts of noble metal compounds such as gold, platinum, palladium, iridium, ruthenium, and rhodium compounds. They can be sensitized optically by means of cyanine and merocyanine dyes.

The emulsions can also comprise compounds that sensitize by development acceleration e.g. compounds of the polyoxyalkylene type such as alkylene oxide condensation products as described i.e. in the U.S. Pat. Nos. 2,531,832 — 2,533,990 — 3,158,484 — 3,210,191, in the United Kingdom patent specification Nos. 920,637 and 991,608 and in the Belgian Patent Specification 648,710, and onium derivatives of amine-oxides as described in the United Kingdom patent specification No. 1,121,696.

The emulsions may comprise stabilizers e.g. heterocyclic nitrogen-containing thioxo compounds such as benzothiazoline-2-thione and 1-phenyl-2-tetrazolin-5-thione and compounds of the hydroxytriazolopyrimidine type. They can also be stabilized with mercury compounds such as the mercury compounds described in the Belgian Patent Specifications 524,121 — 677,337, and 707,386, and in the U.S. Pat. No. 3,179,520. Other suitable stabilizers are azaindenes, preferably tetra- or penta-azaindenes, especially those substituted with hydroxyl or amino groups. Compounds of this type are described by Birr, Z.Wiss.Photogr.Photophys. Photochem. 47, 1–58 (1952).

The light-sensitive emulsion layers may comprise any other type of ingredients such as plasticizers, hardening agents, wetting agents, etc.

The non-diffusing magenta colour couplers described in the present invention are incorporated usually into the green-sensitized silver halide emulsion for forming one of the differently sensitized silver halide emulsion layers of a photographic multilayer colour material. Such photographic multilayer colour material usually comprises a support, a red-sensitized silver halide emulsion layer with a cyan colour coupler, a green-sensitized silver halide emulsion layer with a magenta colour coupler, and a blue-sensitive silver halide emulsion layer with a yellow colour coupler.

The emulsions can be coated on a wide variety of photographic emulsion supports. Typical supports include cellulose ester film, polyvinyl acetal film, polystyrene film, polyethylene terephthalate film and related films or resinous materials, as well as paper and glass. It is also possible to employ paper coated with $\alpha$-olefin polymers e.g. paper coated with polyethylene, polypropylene, ethylene-butylene copolymers, etc.

Photographic materials containing the couplers according to the present invention can be developed with any of the known aromatic, primary amino colour developing substances e.g. p-phenylenediamine and derivatives such as N,N-diethyl-p-phenylenediamine, N-butyl-N-sulphobutyl-p-phenylenediamine, 2-amino-5-diethylaminotoluene, 4-amino-N-ethyl-N-($\beta$-methanesulphonamidoethyl)-m-toluidine, N-hydroxyethyl-N-ethyl-p-phenylenediamine, etc.

The following examples illustrate the present invention.

EXAMPLE 1

117 g of a silver bromoiodide emulsion (2.3 mole % of iodide) containing an amount of silver halide equivalent to 47 g of silver nitrate as well as 73.4 g of gelatin were diluted with 192.5 g of a 7.5% aqueous gelatin solution and 200 g of distilled water. The resulting emulsion was admixed with the latex compound 37 in an amount corresponding to 0.006 mole of the polymerized monomeric coupler. After neutralization of the emulsion and addition of the usual additives such as e.g. stabilizing agents, wetting agents, and hardening agents distilled water was added to make 720 g.

In the same way an emulsion was prepared, which instead of the acylated polymeric colour coupler contained the non-acylated polymeric colour coupler.

The emulsions obtained were coated on a cellulose triacetate support in a ratio of 125 g/sq.m. The emulsion layers were dried and coated with a gelatin protecting layer.

The dried materials were exposed for 1/20 s through a continuous wedge having a constant of 0.3 and developed subsequently for 8 min at 20° C in a developing bath having the following composition:

| | | |
|---|---|---|
| N,N-diethyl-p-phenylenediamine-sulphate | 2.75 | g |
| hydroxyammonium sulphate | 1.2 | g |
| sodium hexametaphosphate | 4 | g |
| anhydrous sodium sulphate | 2 | g |
| anhydrous potassium carbonate | 75 | g |
| potassium bromide | 2.5 | g |
| water to make | 1 | liter |

The developed materials were treated for 2 min at 18°-20° C in an intermediate bath of 30 g of sodium sulphate in 1 l of water.

The materials were rinsed for 15 min in water and treated subsequently in a bleaching bath having the following composition:

| | | |
|---|---|---|
| borax | 20 | g |
| anhydrous potassium bromide | 15 | g |
| anhydrous sodium hydrogen sulphite | 4.2 | g |
| potassium cyanoferrate (III) | 100 | g |
| water to make | 1 | liter |

The bleached materials were rinsed for 5 min in water and fixed in an aqueous solution of 200 g of sodium thiosulphate per litre.

After a final rinsing in water of 15 min the materials were dried.

Magenta wedges having the following photographic characteristics were obtained:

| Colour coupler | relative sensitivity | gamma | $D_{max}$ |
|---|---|---|---|
| non-acylated | 100 | 1.27 | 2.29 |
| acylated | 85 | 1.13 | 2.16 |

EXAMPLE 2

117 g of a silver bromoiodide emulsion (2.3 mole % of iodide) containing per kg an amount of silver halide equivalent to 47 g of silver nitrate as well as 73.4 g of gelatin, are diluted with 192.5 g of a 7.5% aqueous solution of gelatin and 200 g of distilled water. The resulting emulsion was admixed with an emulgate prepared by dissolving 0.006 mole of the compound 23 in 14 ml of ethyl acetate, dispersing the solution in 100 ml of a 5% gelatin solution by means of an ultrasonic power generator, and removing the ethyl acetate by evaporation under reduced pressure. After neutralization of the emulsion and addition of the usual additives such as e.g. stabilizing agents, wetting agents and hardening agents distilled water was added to make 720 g.

In the same way an emulsion containing the non-acylated colour coupler instead of the acylated colour coupler was prepared.

The emulsions obtained were coated on a cellulose triacetate support in a ratio of 125 g/sq.m. The emulsion layers were dried and coated with a gelatin protective layer.

The dried materials were exposed for 1/20 s through a continuous wedge having a constant of 0.3 and developed subsequently for 8 min at 20° C in a developing bath having the following composition:

| | | |
|---|---|---|
| N,N-diethyl-p-phenylenediamine sulphate | 2.75 | g |
| hydroxyammonium sulphate | 1.2 | g |
| sodium hexametaphosphate | 4 | g |
| anhydrous sodium sulphite | 2 | g |
| anhydrous potassium carbonate | 75 | g |
| potassium bromide | 2.5 | g |
| water to make | 1 | liter |

The developed materials were treated for 2 min at 18°-20° C in an intermediate bath of 30 g of sodium sulphate in 1 liter of water.

The materials were rinsed for 15 min in water and treated subsequently in a bleaching bath having the following composition:

| | | |
|---|---|---|
| borax | 20 | g |
| anhydrous potassium bromide | 15 | g |
| anhydrous sodium hydrogen sulphite | 4.2 | g |
| potassium cyanoferrate (III) | 100 | g |
| water to make | 1 | liter |

The bleached materials were rinsed for 5 min in water and fixed in an aqueous solution of 200 g of sodium thiosulphate per liter.

After a final rinsing in water the materials were dried. Magenta wedges having the following photographic characteristics were obtained:

| colour coupler | relative sensitivity | gamma | $D_{max}$ |
|---|---|---|---|
| non-acylated | 100 | 0.98 | 2.22 |
| acylated | 115 | 0.92 | 2.16 |

EXAMPLE 3

Example 2 was repeated with the difference that colour couplers 17 and 34 were used and maximum density of the magenta wedges obtained was compared with the maximum density obtained with the non-acylated parent compound.

The results are listed in the following table.

| Coupler | $D_{max}$ |
|---|---|
| non-acylated parent compound | 2.79 |
| compound 17 | 2.75 |
| compound 34 | 3.09 |

We claim:

1. Light-sensitive material comprising at least one silver halide emulsion layer and a 2-acyl-3-pyrazolin-5-one coupler carrying an alkyl group or aryl group in the 1-position and an alkyl group, aryl group, anilino group or acylamino group in the 3-position.

2. Light-sensitive material according to claim 1, wherein the coupler corresponds to the following structural formula:

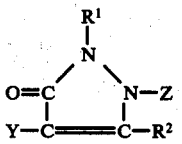

in which:

$R^1$ represents an alkyl group or an aryl group, Y represents hydrogen, halogen, a sulpho group in acid or salt form, an alkoxy group, an aryloxy group, an alkylthio group, an arylthio group, an acyloxy group, a heterocyclic thio group, an arylazo group, a benzothiazolyl group or an alkyl group, $R^2$ represents an alkyl group, an aryl group, an anilino group, or an acylamino group, and Z represents (1) an acyl group deriving from an organic carboxylic acid, (2) the group

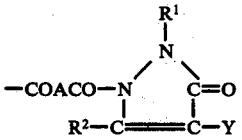

in which $R^1$, $R^2$, and Y have the significance defined above, and

A represents an alkylene or arylene group, or (3) an alkoxycarbonyl group or aryloxycarbonyl group.

* * * * *